US006666264B2

(12) United States Patent
Berning

(10) Patent No.: US 6,666,264 B2
(45) Date of Patent: Dec. 23, 2003

(54) HEAT EXCHANGER

(75) Inventor: Thomas H. Berning, Sidney, OH (US)

(73) Assignee: American Trim, LLC, Lima, OH (US)

( * ) Notice: Subject to any disclaimer, the term of this patent is extended or adjusted under 35 U.S.C. 154(b) by 0 days.

(21) Appl. No.: 09/977,872

(22) Filed: Oct. 15, 2001

(65) Prior Publication Data

US 2003/0070796 A1 Apr. 17, 2003

(51) Int. Cl.[7] ..... F28F 9/02; B23K 31/02; B23P 15/26

(52) U.S. Cl. ..... 165/173; 228/183; 165/175; 29/890.052

(58) Field of Search ..... 165/173, 175, 165/176, 158; 29/890.052, 890.039; 228/183

(56) References Cited

U.S. PATENT DOCUMENTS

| | | | | | |
|---|---|---|---|---|---|
| 3,703,925 | A | * | 11/1972 | Ireland et al. | 165/151 |
| 3,866,675 | A | | 2/1975 | Bardon et al. | 165/173 |
| 4,738,308 | A | * | 4/1988 | Moranne | 165/173 |
| 5,178,211 | A | * | 1/1993 | Bauer et al. | 165/153 |
| 5,236,336 | A | | 8/1993 | Hitoshi | 165/153 |
| 5,265,672 | A | | 11/1993 | Aoki | 165/149 |
| 5,390,733 | A | | 2/1995 | Young | 165/173 |
| 5,445,219 | A | | 8/1995 | Hutto et al. | 165/173 |
| 5,501,271 | A | | 3/1996 | Wijkstrom | 165/173 |
| 5,579,833 | A | * | 12/1996 | Wijkstrom | 165/173 |
| 5,836,384 | A | | 11/1998 | Wijkstrom et al. | 165/173 |
| 6,065,533 | A | * | 5/2000 | Woodhull, Jr. | 165/149 |
| 6,129,146 | A | * | 10/2000 | Krueger et al. | 165/173 |
| 6,173,765 | B1 | * | 1/2001 | Uchikawa et al. | 165/173 |
| 6,250,381 | B1 | | 6/2001 | Nishishita | 165/175 |
| 6,357,521 | B1 | * | 3/2002 | Sugimoto et al. | 165/173 |

FOREIGN PATENT DOCUMENTS

| | | | | | |
|---|---|---|---|---|---|
| JP | 405060485 | A | * | 3/1993 | 165/173 |

* cited by examiner

*Primary Examiner*—Henry Bennett
*Assistant Examiner*—Tho V Duong
(74) *Attorney, Agent, or Firm*—Rankin, Hill, Porter & Clark LLP

(57) ABSTRACT

The present invention provides a heat exchanger including a tank, a plurality of tubes in fluid communication with the tank, and a plurality of fins extending between the tubes. The tank includes a header member and a cover member, each of which is formed from a single sheet of aluminum. The header member includes an elongate generally planar base section having first and second ends and a middle portion disposed between the first and second ends. The header member also includes a flange section that extends along one edge of the base section and a wall section that extends along the opposite edge of the base section. The cover member has a central section that is spaced apart from the middle portion of the header member and a periphery that is joined to the first and second ends of the base section, the flange section, and the wall section.

11 Claims, 5 Drawing Sheets

HEAT EXCHANGER

FIELD OF THE INVENTION

The present invention provides a heat exchanger and, more particularly, a heat exchanger having a tank formed from two single sheets of aluminum.

BACKGROUND OF THE INVENTION

Presently, most heat exchanger units for use in motor vehicles (e.g., radiators and charge air coolers) are made by mounting aluminum tubes and fins between two tanks (also sometimes referred to in the art as manifolds) that act as reservoirs for the liquid to be cooled. In charged air cooler applications, the heat exchanger comprises a cast aluminum tank that is welded to an aluminum header. In radiator applications, the tank usually consists of an aluminum header and a plastic tank. A plurality of tubes are connected to the aluminum header, which is then crimped to the plastic tank using a rubber O-ring as a sealing element to create a leak-proof vessel. The plastic tank is typically molded so as to provide mounting points for attachment of the heat exchanger to the motor vehicle and also to provide mounting points for accessories that are mounted to the heat exchanger.

One of the problems associated with heat exchangers of the type described in the previous paragraph is that fluid can leak from the tank at the O-ring joint. Furthermore, the plastic tank tends to warp during and after processing, which can also lead to additional leaking and assembly problems. Moreover, recycling of this type of heat exchanger is problematic because the plastic tank must be mechanically separated from the remaining parts of the heat exchanger.

SUMMARY OF THE INVENTION

The present invention provides a heat exchanger comprising a tank, a plurality of tubes in fluid communication with the tank, and a plurality of fins extending between the tubes. The tank consists essentially of a header member and a cover member, each of which is formed from a single sheet of aluminum. The header member includes an elongate generally planar base section having first and second ends and a middle portion disposed between the first and second ends. The header member also includes a flange section that extends along one edge of the base section and a wall section that extends along the opposite edge of the base section. The cover member has a central section that is spaced apart from the middle portion of the header member and a periphery that is joined to the first and second ends of the base section, the flange section, and the wall section. The cover member is preferably joined to the header member by brazing. The heat exchanger can accommodate mounts for mounting the heat exchanger to motor vehicle or for mounting various accessories to the heat exchanger at virtually any location adjacent to the joint between the cover member and the header member.

A heat exchanger according to the present invention preferably comprises an all-aluminum structure, meaning that the plurality of tubes, plurality of fins, and tank are all constructed of aluminum. Thus, the heat exchanger requires no disassembly in order to facilitate recycling. Furthermore, a heat exchanger according to the present invention does not rely on rubber O-rings to insure a seal between the tank and header. Therefore, a heat exchanger according to the present invention is less prone to leakage from fatigue or heat stresses.

The foregoing and other features of the invention are hereinafter more fully described and particularly pointed out in the claims, the following description setting forth in detail certain illustrative embodiments of the invention, these being indicative, however, of but a few of the various ways in which the principles of the present invention may be employed.

DETAILED DESCRIPTION OF PREFERRED EMBODIMENTS

A heat exchanger according to the present invention comprises a tank, a plurality of tubes in fluid communication with the tank, and a plurality of fins extending between the tubes. The tubes and fins are preferably formed of aluminum.

Figure 1:
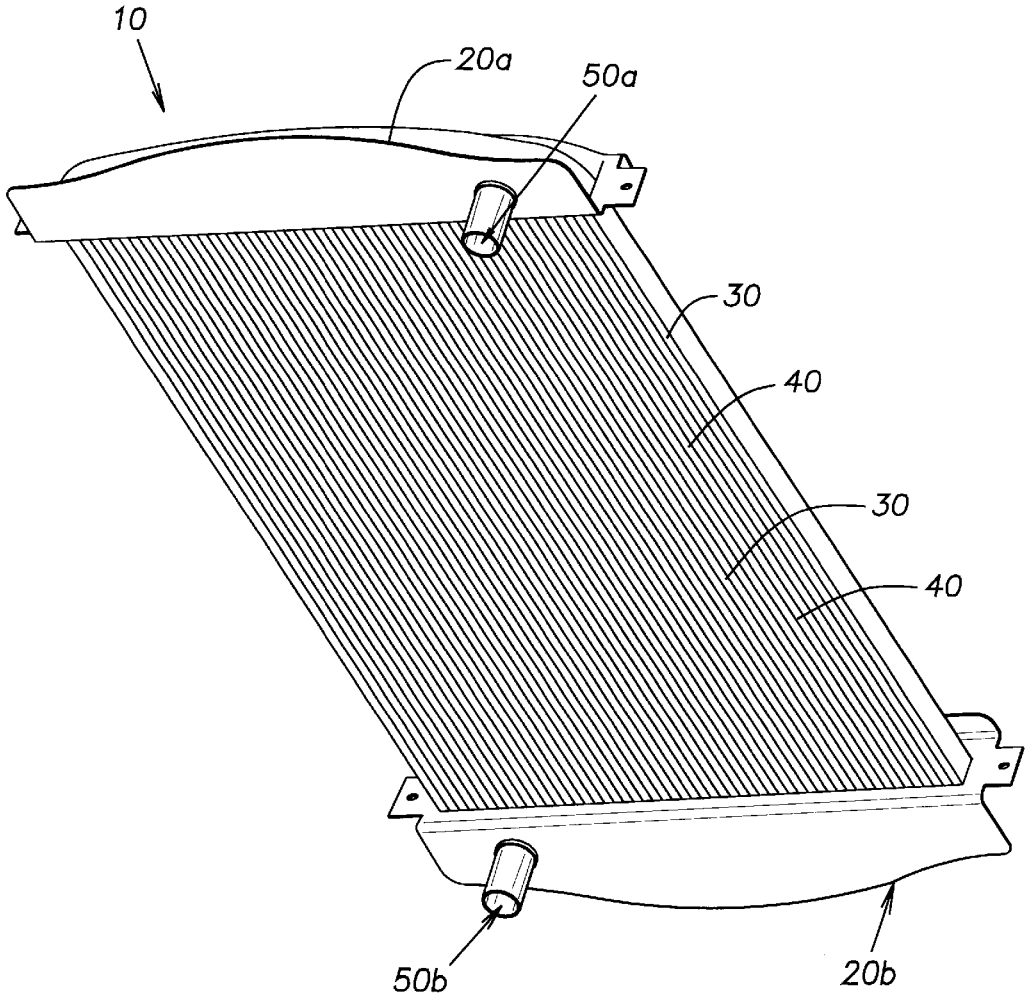
FIG. 1 is a perspective view of a preferred embodiment of a heat exchanger according the present invention.

With reference to FIG. 1, which shows a perspective view of a preferred embodiment of a heat exchanger according to the invention, a heat exchanger 10 comprises a first tank 20*a* and a second tank 20*b*, a plurality of tubes 30 in fluid communication with the first tank 20*a* and the second tank 20*b*, and a plurality of fins 40 extending between the tubes 30. In the preferred embodiment, both the first tank 20*a* and second tank 20*b* are identical in configuration. However, it will be appreciated that heat exchangers can be formed using only one tank, or using two or more tanks having different configurations.

Fluid that needs to be cooled is pumped into the first tank 20*a* through an inlet port 50*a*. The fluid passes from the first tank 20*a* through the tubes 30 where the heat of the fluid is exchanged with cooling air passing over and around the tubes 30 and fins 40. The cooled fluid then passes from the tubes 30 into the second tank 20*b* and then flows out of outlet port 50*b*. A heat exchanger of this type is sometimes referred to in the art as a one-path cross flow type heat exchanger or radiator, and is particularly useful in motor vehicle applications to cool engine coolant.

The tank of a heat exchanger according to the present invention consists essentially of a header member that is formed from a single sheet of aluminum and a cover member that is also formed from a single sheet of aluminum. In this respect, the tank can be described as a two-piece assembly.

Figure 2:
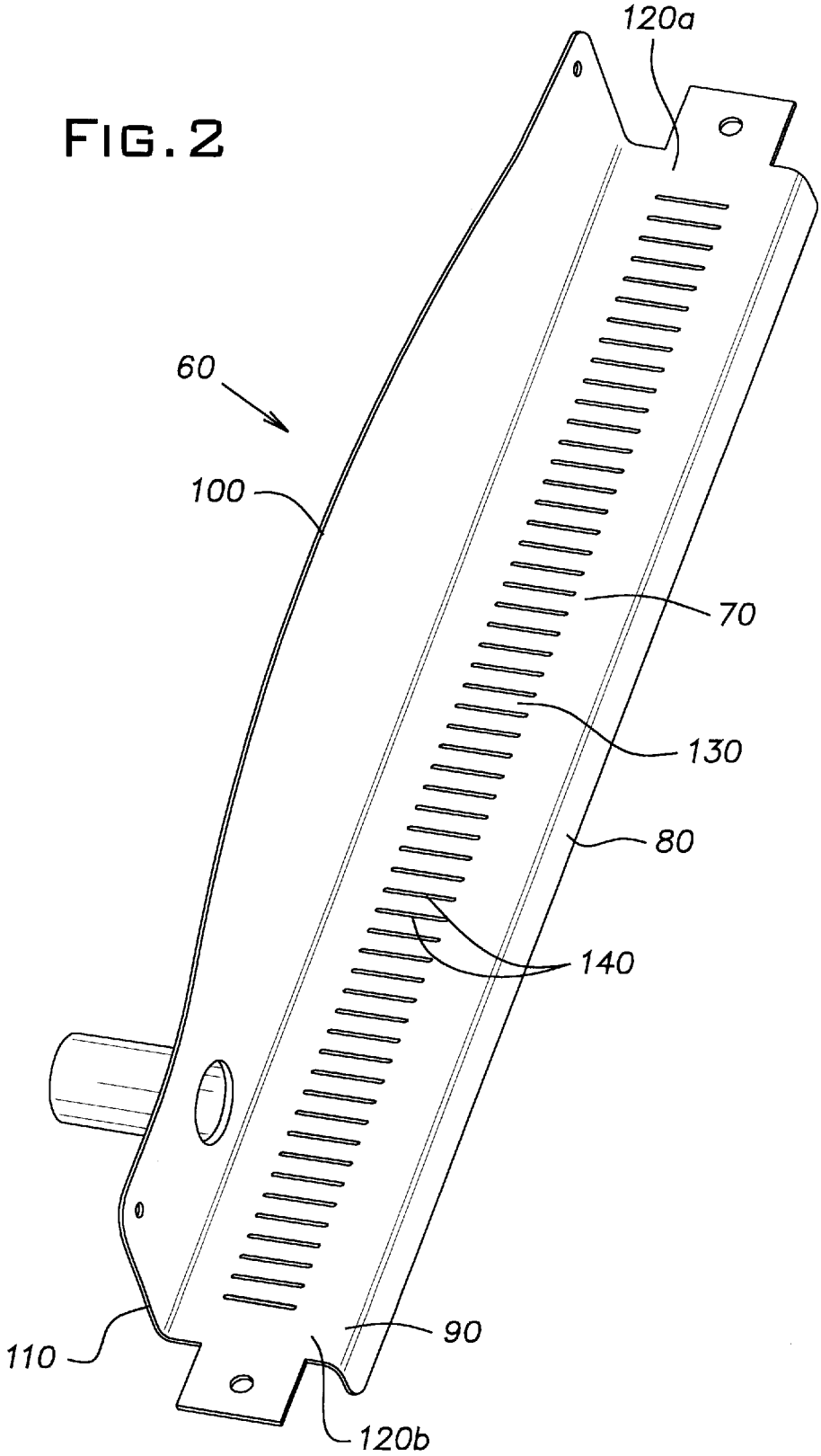
FIG. 2 is a perspective view of a header member of the heat exchanger shown in FIG. 1.

FIG. 2 shows a perspective view of a header member 60 of one of the tanks 20*a* or 20*b* (they are identical) in the heat exchanger 10 shown in FIG. 1. The header member 60 has an elongate generally planar base section 70, a flange section 80 extending along an edge 90 of the base section 70, and a wall section 100 extending along an opposite edge 110 of the base section 70. The base section 70 has first and second ends 120*a* and 120*b*, respectively, and a middle portion 130 disposed between the first and said second ends 120*a*, 120*b*. A plurality of openings 140 are provided in the middle portion 130 of the base section 70. Each of the openings 140 is sized to receive one of the plurality of tubes 30.

In the preferred embodiment of the invention illustrated in FIG. 2, the flange section 80 extends downwardly from the 90 edge of the base section 70 in a direction generally parallel with the tubes 30, and the wall section 100 extends upwardly from the opposite edge 110 of the base section 70 in a direction generally away from the tubes 30. However, it will be appreciated that the orientation of the flange section could be reversed provided that the periphery of the cover member was also modified to contact the flange section.

Figure 3:
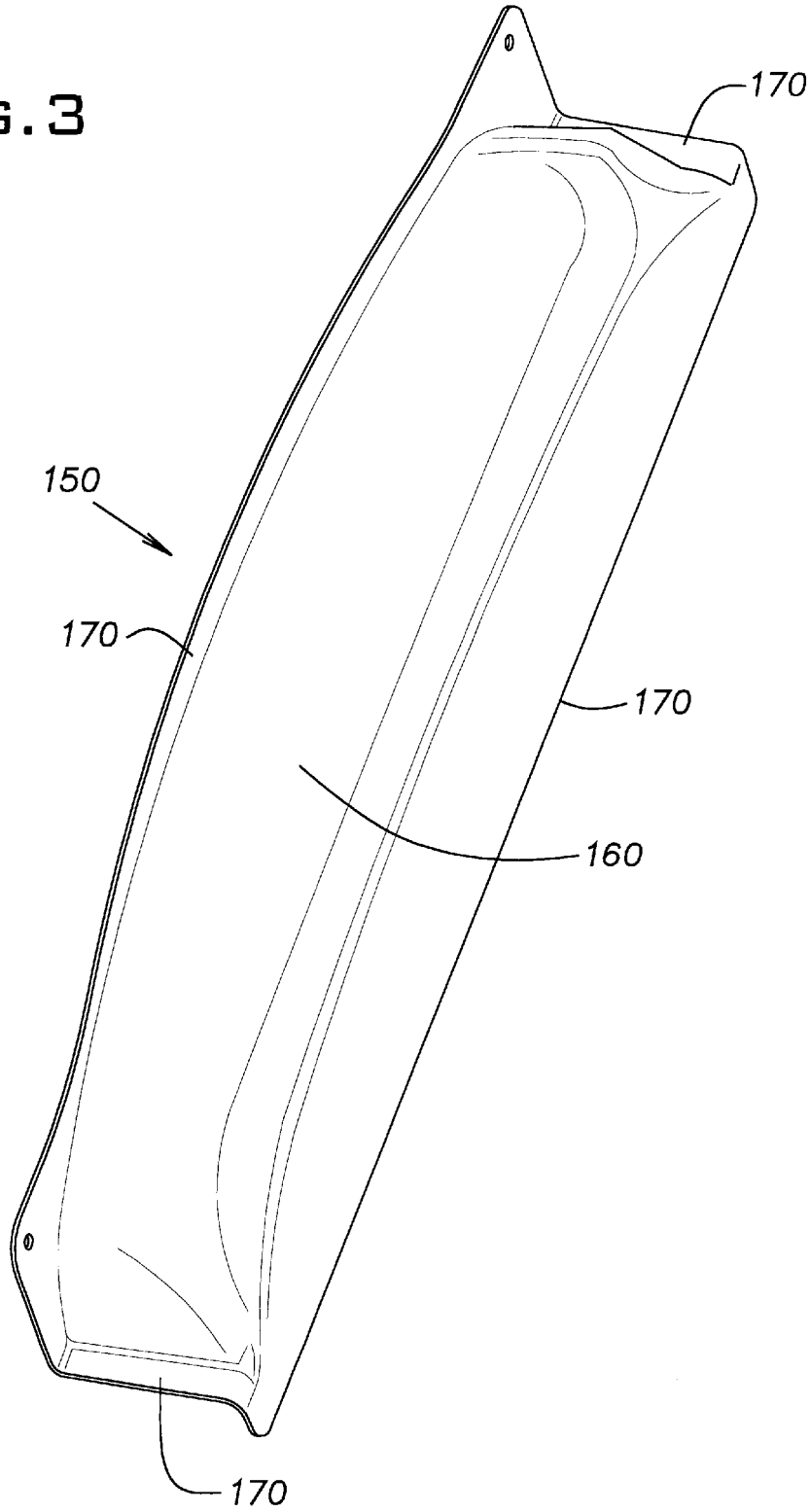
FIG. 3 is a perspective view of a cover member of the heat exchanger shown in FIG. 1.

FIG. 3 shows a perspective view of a cover member 150 of one of the tanks 20*a* or 20*b* (they are identical) in the heat exchanger 10 shown in FIG. 1. The cover member 150 has a central section 160 that is prefereably dome-shaped. The periphery 170 of the cover member 150 is arranged to make contact with the first and second ends 120*a,* 120*b,* the flange section 80, and the wall section 100 of the header member 60.

Figure 4:
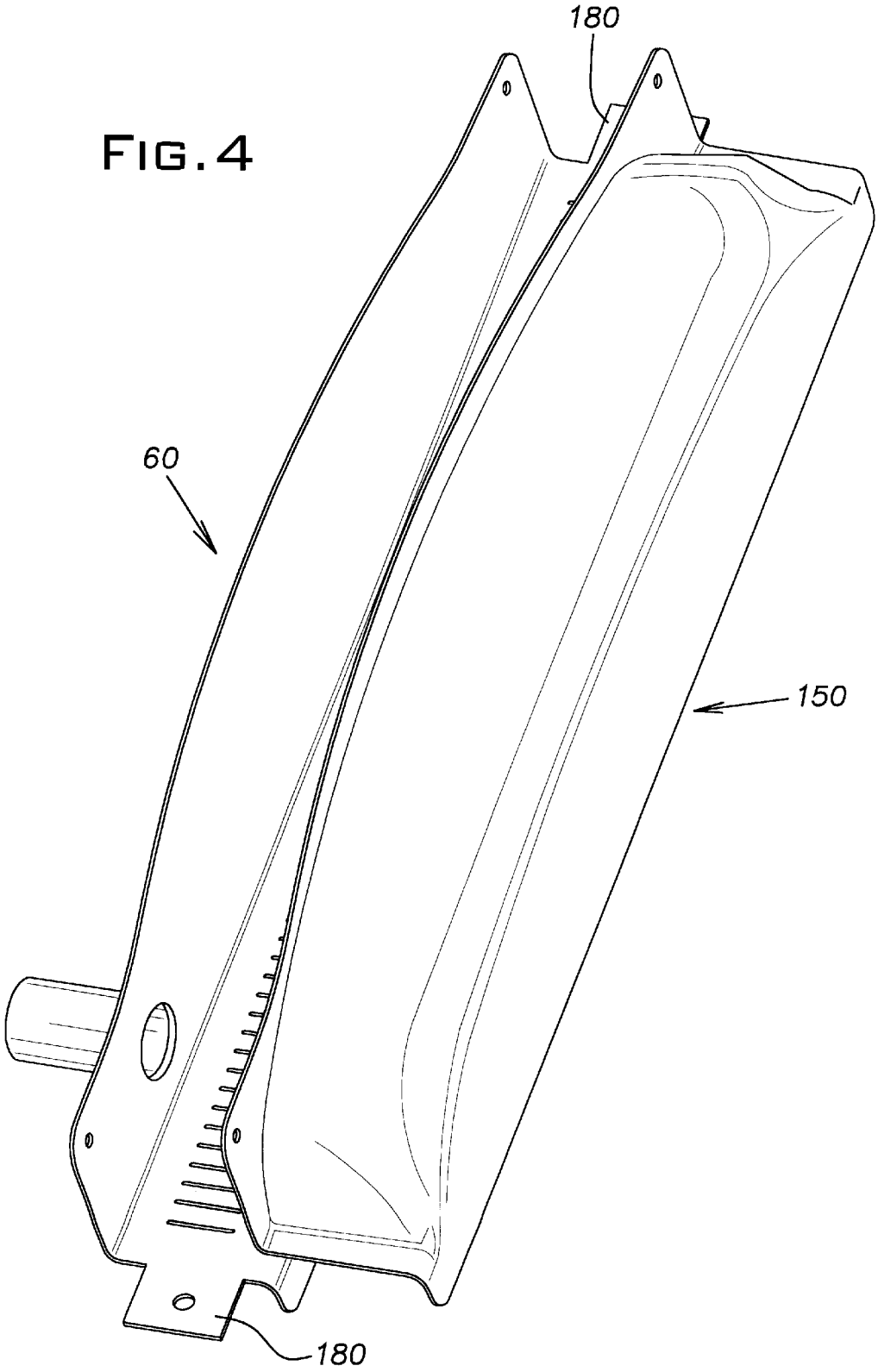
FIG. 4 is a perspective view of the header member and cover member shown in FIGS. 2 and 3, respectively, in the process of being brought together to be joined.

FIG. 4 shows the cover member 150 and header member 60 in the process of being brought together to be joined to form a tank 20. It should be noted that, as illustrated in FIG. 4, the first and second ends 120*a,* 120*b* of said base section 70 of the header member 60 can extend beyond the point where the periphery 170 of the cover member contact the ends 120*a,* 120*b,* to form mounting points 180 for attaching the heat exchanger 10 to a motor vehicle or other device and/or for mounting accessories.

It will be appreciated that the location of the mounting points 180 is not per se critical, and that the header member and cover member can be modified in various manners to allow for various mounting options in addition to the mounting options illustrated in FIG. 4. In other words, the heat exchanger 10 can accommodate mounts for mounting the heat exchanger to motor vehicle or for mounting various accessories to the heat exchanger at virtually any location adjacent to the joint between the cover member and the header member.

Figure 5:
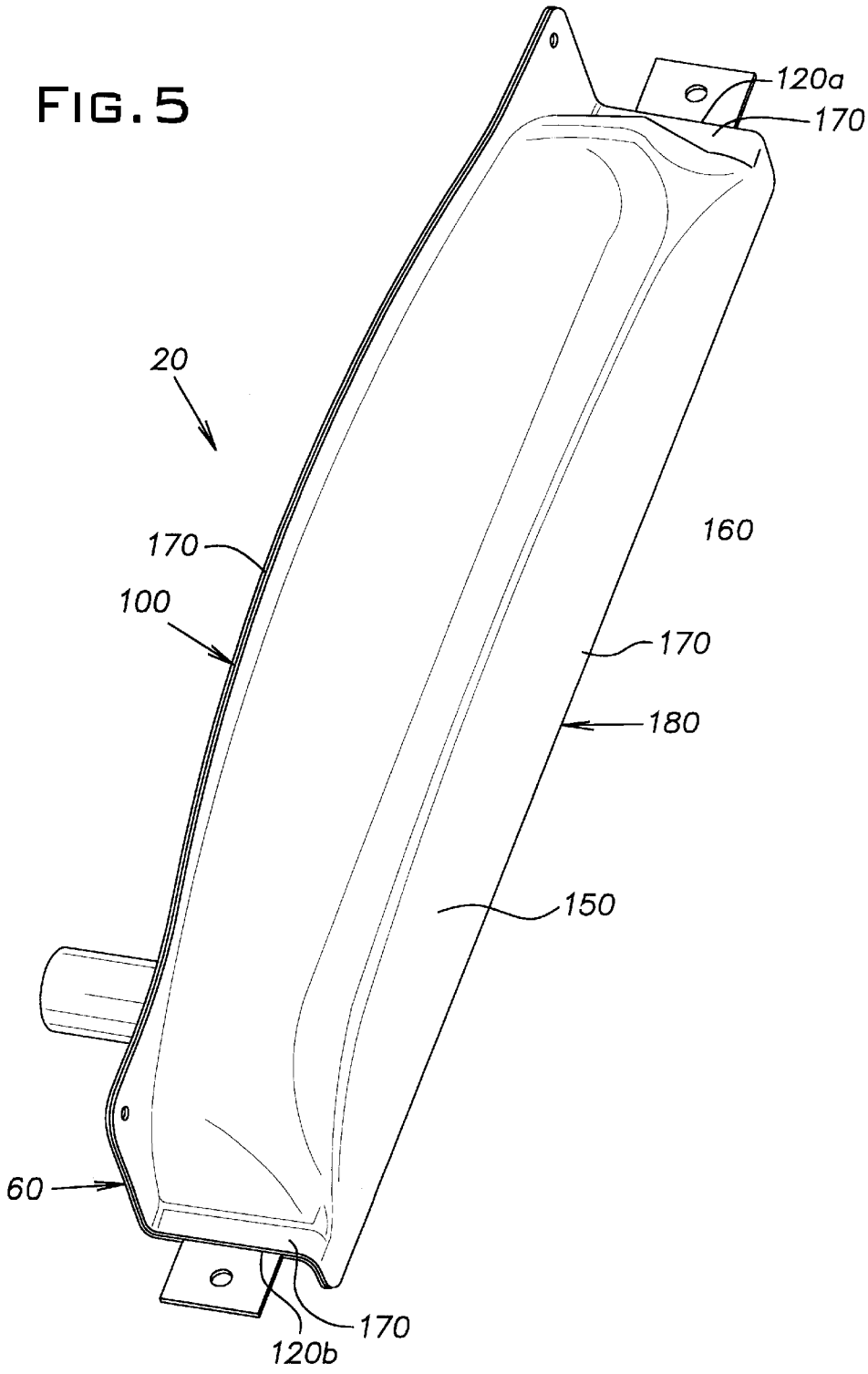
FIG. 5 is a perspective view of the header member and cover member shown in FIG. 4 after they have been joined.

FIG. 5 is a perspective view of the cover member 150 and header member 60 shown in FIG. 4 after they have been brought together and joined to form a tank 20. As shown in FIG. 5, the central section 160 of the cover member 150 is spaced apart from the middle portion 130 of the header member 60, but the periphery 170 of the cover member 150 is joined to the first and second ends 120*a,* 120*b,* the flange section 80, and the wall section 100 of the header member 60 to form a fluid-tight seal between the cover member 150 and the header member 60.

The header member is preferably made as a stamping and is pierced (to form the openings), extruded (to form a collar for the inlet/outlet port), and then formed into shape (to form the flange section and the wall section). The cover member is preferably a drawn and trimmed stamping with a periphery formed to match the shape of the first and second ends, wall section, and flange section of the header member. The portion of the periphery of the cover member contacting the header member should be sufficient to allow for brazing, which is well known in the art. The cover member is preferably joined to the header member after assembly of the tubes and fins, which can be assembled using a conventional core building assembly. The cover member can is preferably secured to the header member prior to brazing using tabs, staking, or by clamping the two parts together in a brazing fixture. After the cover member is secured to the header member, the entire assembly is preferably placed in a brazing oven.

The heat exchanger according to the present invention is preferably formed of aluminum parts. As used throughout the instant description and in the appended claims, the term "aluminum" is not intended to be strictly construed as referring to pure aluminum, but should be understood to refer to pure aluminum and the various alloys of aluminum. In the most preferred embodiment of the invention, the tubes, fins, and tank(s) are all formed from aluminum, and thus can be recycled without the need for labor intensive disassembly.

The heat exchanger according to the present invention also eliminates the need for rubber O-rings, which are prone to leakage and weakening due to fatigue and heat stress. Heat exchangers according to the present invention are particularly useful as radiators for motor vehicles, but can also be used in other applications where it is necessary to cool fluids, or for air to air heat exchange.

Additional advantages and modifications will readily occur to those skilled in the art. Therefore, the invention in its broader aspects is not limited to the specific details shown and described herein. Various modifications may be made without departing from the spirit or scope of the general inventive concept as defined by the appended claims and their equivalents.

What is claimed:

1. A heat exchanger comprising a tank, a plurality of tubes in fluid communication with said tank, and a plurality of fins extending between said tubes, said tank consisting essentially of:

a header member formed from a single sheet of aluminum having a header peripheral edge and a header inner side and a header outer side, said header member having an elongate generally planar base section having first and second ends and a middle portion disposed between said first and said second ends, said first and second ends having respective first and second inner side surfaces adjacent to said header peripheral edge, said middle portion being provided with a plurality of openings each sized to receive one of said plurality of tubes, a flange section extending along a first edge of said base section and having a flange inner side surface adjacent to said header peripheral edge, and a wall section extending along an opposite second edge of said base section and having a wall inner side surface adjacent to said header peripheral edge, said first and second inner side surfaces, said flange inner side surface, and said wall inner side surface cooperating to define a continuous header inner side surface adjacent to said header peripheral edge; and a cover member formed of a single sheet of aluminum, said cover member having a central section that is spaced apart from said middle portion of said header member, said cover member further having a cover peripheral edge and a cover inner side and a cover outer side, and said cover member further having a continuous cover inner side surface adjacent to said cover peripheral edge, said header inner side surface contacting said cover inner side surface and defining a fluid-tight seal between said cover member and said header member, said seal not extending beyond said header peripheral edge and said cover peripheral edge, and wherein said cover member is elongate and said central portion of said cover member is longitudinally dome-shaped, whereby said central section of said cover member has a convex curvature such that an apex of said curvature is spaced about equidistant from said first and second ends.

2. A heat exchanger comprising a tank, a plurality of tubes in fluid communication with said tank, and a plurality of fins extending between said tubes, said tank consisting essentially of:

a header member formed from a single sheet of aluminum having a header peripheral edge and a header inner side and a header outer side, said header member having an elongate generally planar base section having first and second ends and a middle portion disposed between said first and said second ends, said first and second ends having respective first and second inner side surfaces adjacent to said header peripheral edge, said middle portion being provided with a plurality of openings each sized to receive one of said plurality of tubes, a flange section extending along a first edge of said base section and having a flange inner side surface adjacent to said header peripheral edge, and a wall section extending along an opposite second edge of said base section and having a wall inner side surface adjacent to said header peripheral edge, said first and second inner side surfaces, said flange inner side surface, and said wall inner side surface cooperating to define a continuous header inner side surface adjacent to said header peripheral edge; and a cover member formed of a single sheet of aluminum, said cover member having a central section that is spaced apart from said middle portion of said header member, said cover member further having a cover peripheral edge and a cover inner side and a cover outer side, and said cover member further having a continuous cover inner side surface adjacent to said cover peripheral edge, said header inner side surface contacting said cover inner side surface and defining a fluid-tight seal between said cover member and said header member, said seal not extending beyond said header peripheral edge and said cover peripheral edge, wherein said flange section of said header member extends downwardly from said first edge of said base section in a direction generally parallel with said plurality of tubes, and wherein said wall section of said header member extends upwardly from said opposite second edge of said base section in a direction generally away from said plurality of tubes.

3. A heat exchanger comprising a tank, a plurality of tubes in fluid communication with said tank, and a plurality of fins extending between said tubes, said tank consisting essentially of:

a header member formed from a single sheet of aluminum having a header peripheral edge and a header inner side and a header outer side, said header member having an elongate generally planar base section having first and second ends and a middle portion disposed between said first and said second ends, said first and second ends having respective first and second inner side surfaces adjacent to said header peripheral edge, said middle portion being provided with a plurality of openings each sized to receive one of said plurality of tubes, a flange section extending along a first edge of said base section and having a flange inner side surface adjacent to said header peripheral edge, and a wall section extending along an opposite second edge of said base section and having a wall inner side surface adjacent to said header peripheral edge, said first and second inner side surfaces, said flange inner side surface, and said wall inner side surface cooperating to define a continuous header inner side surface adjacent to said header peripheral edge; and a cover member formed of a single sheet of aluminum, said cover member having a central section that is spaced apart from said middle portion of said header member, said cover member further having a cover peripheral edge and a cover inner side and a cover outer side, and said cover member further having a continuous cover inner side surface adjacent to said cover peripheral edge, said header inner side surface contacting said cover inner side surface and defining a fluid-tight seal between said cover member and said header member, said seal not extending beyond said header peripheral edge and said cover peripheral edge, and wherein said wall section of said header member is provided with an inlet/outlet hole.

4. A heat exchanger comprising a tank, a plurality of tubes in fluid communication with said tank, and a plurality of fins extending between said tubes, said tank consisting essentially of:

a header member formed from a single sheet of aluminum, said header member having an elongate generally planar base section having first and second ends and a middle portion disposed between said first and said second ends, said middle portion being provided with a plurality of openings each sized to receive one of said plurality of tubes, a flange section extending along a first edge of said base section, and a wall section extending along an opposite second edge of said base section; and a cover member formed of a single sheet of aluminum, said cover member having a central section that is spaced apart from said middle portion of said header member and a periphery that is joined to said first and second ends, said flange section, and said wall section of said header member to form a fluid-tight seal between said cover member and said header member, wherein said first and second ends of said base section of said header member extend beyond said periphery of said cover member to form mounting points for attaching said heat exchanger to a motor vehicle.

5. The heat exchanger according to claim 4 wherein said cover member is elongate and said central portion of said cover member is longitudinally dome-shaped, whereby said central section of said cover member has a convex curvature such that an apex of said curvature is spaced about equidistant from said first and second ends.

6. The heat exchanger according to claim 4 wherein said plurality of tubes and said plurality of fins are aluminum.

7. The heat exchanger according to claim 4 wherein said flange section of said header member extends downwardly from said first edge of said base section in a direction generally parallel with said plurality of tubes.

8. The heat exchanger according to claim 7 wherein said wall section of said header member extends upwardly from said opposite second edge of said base section in a direction generally away from said plurality of tubes.

9. The heat exchanger according to claim 4 wherein said header member is a stamped header member.

10. The heat exchanger according to claim 9 wherein said plurality of openings in said header member are non-circular and define a generally linear longitudinal array.

11. The heat exchanger according to claim 4 wherein said wall section of said header member is provided with an inlet/outlet hole.

* * * * *